US008686849B2

(12) United States Patent
Lee et al.

(10) Patent No.: US 8,686,849 B2
(45) Date of Patent: Apr. 1, 2014

(54) METHOD OF ALARM HANDLING IN WIRELESS SENSOR NETWORKS

(75) Inventors: Huang Lee, Fremont, CA (US); Murat Senel, Mountain View, CA (US)

(73) Assignee: Robert Bosch GmbH, Stuttgart (DE)

( * ) Notice: Subject to any disclaimer, the term of this patent is extended or adjusted under 35 U.S.C. 154(b) by 482 days.

(21) Appl. No.: 12/853,548

(22) Filed: Aug. 10, 2010

(65) Prior Publication Data

US 2012/0038475 A1 Feb. 16, 2012

(51) Int. Cl.
*G08B 23/00* (2006.01)

(52) U.S. Cl.
USPC ..... 340/502; 340/426.25; 340/505; 340/506; 340/539.22; 340/521; 370/315; 370/338

(58) Field of Classification Search
USPC ..... 340/426.25, 539.22, 502, 505, 506, 340/521; 370/315, 338
See application file for complete search history.

(56) References Cited

U.S. PATENT DOCUMENTS 3,839,707 A * 10/1974 Woodward et al. ..... 714/4.4
4,023,139 A * 5/1977 Samburg ..... 340/506
4,060,803 A * 11/1977 Ashworth, Jr. ..... 340/506
4,091,384 A * 5/1978 Green, Jr. ..... 340/506
4,560,978 A * 12/1985 Lemelson ..... 340/539.22
4,785,284 A * 11/1988 Kimura ..... 340/505
4,864,519 A * 9/1989 Appleby et al. ..... 700/292
5,528,219 A * 6/1996 Frohlich et al. ..... 340/540
5,638,046 A * 6/1997 Malinowski ..... 340/539.17
5,892,441 A * 4/1999 Woolley et al. ..... 340/539.26
5,977,913 A * 11/1999 Christ ..... 342/465
6,166,644 A * 12/2000 Stroda ..... 340/573.4
6,317,039 B1 * 11/2001 Thomason ..... 340/505
6,624,750 B1 * 9/2003 Marman et al. ..... 340/506

(Continued)

FOREIGN PATENT DOCUMENTS

EP 1176567 A2 1/2002
EP 1244081 A1 9/2002

(Continued)

OTHER PUBLICATIONS

Keshavarzian, Abtin; Lee, Huang; Venkatraman, Lakshmi: "Wakeup Scheduling in Wireless Sensor Networks"; Proc. of the ACM International Symposium on Mobile Ad Hoc Network and Computing; May 22-25, 2006; Florence, Italy; Copyright 2006 ACM 1-59593-368-9/06/0005; 12 pages.

(Continued)

*Primary Examiner* — George Bugg
*Assistant Examiner* — Paul Obiniyi
(74) *Attorney, Agent, or Firm* — Maginot, Moore & Beck

(57) ABSTRACT

A method of wirelessly transmitting alarm signals includes wirelessly transmitting an alarm signal from a transmitting station. It is determined whether an acknowledgement signal wirelessly transmitted from an access point in response to the access point receiving the alarm signal has been received by the transmitting station. A relaying station is woken up and kept awake during a plurality of periodic time intervals for overhearing transmissions from the transmitting station. If it is determined that an acknowledgement signal from the access point has not been received by the transmitting station, then the alarm signal is wirelessly re-transmitting from the transmitting station during at least one of the time intervals in which the relaying station is awake. The alarm signal is received at the relaying station. The alarm signal is transmitted from the relaying station to the access point.

17 Claims, 10 Drawing Sheets

(56) References Cited

U.S. PATENT DOCUMENTS

| | | | | |
|---|---|---|---|---|
| 7,242,294 | B2 * | 7/2007 | Warrior et al. | 340/539.22 |
| 7,274,907 | B1 * | 9/2007 | Perotti et al. | 455/11.1 |
| 7,304,976 | B2 * | 12/2007 | Mao et al. | 370/338 |
| 7,330,457 | B2 * | 2/2008 | Panwar et al. | 370/338 |
| 7,383,019 | B1 * | 6/2008 | Thorsted et al. | 455/11.1 |
| 7,738,413 | B2 * | 6/2010 | Varaiya et al. | 370/321 |
| 7,761,049 | B2 * | 7/2010 | Zeng et al. | 455/7 |
| 7,813,326 | B1 * | 10/2010 | Kelm et al. | 370/338 |
| 7,843,867 | B2 * | 11/2010 | Gopalakrishnan et al. | 370/315 |
| 2004/0140925 | A1 * | 7/2004 | Kim | 342/28 |
| 2004/0190476 | A1 * | 9/2004 | Bansal et al. | 370/338 |
| 2004/0224713 | A1 * | 11/2004 | Schreyer et al. | 455/521 |
| 2005/0242943 | A1 * | 11/2005 | Matsumoto et al. | 340/521 |
| 2006/0090079 | A1 * | 4/2006 | Oh et al. | 713/186 |
| 2006/0176169 | A1 * | 8/2006 | Doolin et al. | 340/521 |
| 2006/0176863 | A1 * | 8/2006 | Robinson et al. | 370/338 |
| 2007/0060157 | A1 * | 3/2007 | Gopalakrishnan et al. | 455/450 |
| 2007/0152813 | A1 * | 7/2007 | Mathur et al. | 340/539.22 |
| 2007/0198850 | A1 * | 8/2007 | Martin et al. | 713/186 |
| 2008/0122655 | A1 * | 5/2008 | Sedelius Horberg et al. | 340/984 |
| 2008/0137585 | A1 * | 6/2008 | Loyola et al. | 370/315 |
| 2008/0181101 | A1 * | 7/2008 | Oh et al. | 370/218 |
| 2010/0008286 | A1 * | 1/2010 | Abedi | 370/315 |
| 2010/0067422 | A1 * | 3/2010 | Kadous et al. | 370/311 |
| 2010/0182916 | A1 * | 7/2010 | Drewes et al. | 370/252 |

FOREIGN PATENT DOCUMENTS

| | | | | |
|---|---|---|---|---|
| EP | 1 780 951 | A2 | 5/2007 | |
| EP | 1780951 | A2 * | 5/2007 | |
| EP | 2 081 313 | A1 | 7/2009 | |
| EP | 2081313 | A2 * | 7/2009 | H04L 1/00 |
| WO | WO 2009/006092 | A1 | 1/2009 | |

OTHER PUBLICATIONS

Lu, Mei-Hsuan; Steenkiste, Peter; Chen, Tsuhan; "Design, Implementation and Evaluation of an Efficient Opportunistic Retransmission Protocol"; MobiCom; Sep. 20-25, 2009; Beijing, China; Copyright 2009 ACM 978-1-60558-702-8/09/09, 12 pages.

Keshavarzian, Abtin; Lee, Huang; Venkatraman, Lakshmi; "Wakeup Scheduling in Wireless Sensor Networks"; MobiHoc, May 22-25, 2006; Florence, Italy; Copyright 2006 ACM 1-59593-368-9/06/0005; 12 pages.

* cited by examiner

1000

METHOD OF ALARM HANDLING IN WIRELESS SENSOR NETWORKS

BACKGROUND OF THE INVENTION

1. Field of the Invention

The present invention relates to alarm handling in wireless security or fire alarm systems, and, more particularly, to alarm handling in IEEE 802.11-based wireless security or fire alarm systems.

2. Description of the Related Art

Generally proprietary technologies or ZigBee/IEEE802.15.4 based technologies are used for wireless security systems, such as intrusion detection, fire, and alarm systems. However, IEEE802.11 based wireless security/fire alarm systems are not known in the prior art.

In typical wireless security/fire systems, the length of the network lifetime is critical. Because changing the battery of the sensor unit/station is very inconvenient for the customer, such networks are designed to have long battery lifetimes of multiple years. On the other hand, it would be desirable for such delay sensitive systems that stations in a network be able to receive or transmit network packets at any time. Thus, it is not desired to allow a sensor/station to stay in a power saving mode all the time because the sensor/station would not be able to receive or transmit any network packets while in the power saving mode.

Another problem of the prior art is that the channel from the sensor unit/station to the access point/hub may have such bad quality that alarm messages from the sensor/station cannot reach the destined access point/hub.

What is neither disclosed nor suggested by the prior art is a IEEE802.11 based wireless security/fire alarm system in which the above-described and other limitations of the prior art may be improved upon.

SUMMARY OF THE INVENTION

The present invention may provide a method referred to as a "wake-up-overhear-relay method" that can increase the reliability of alarm handling in IEEE802.11-based wireless security or fire alarm systems. The method of the invention may enable intrusion detection/fire sensors/stations to relay their messages reliably, even if the communication link between the sensor/station and the hub/central unit/access point (AP) has poor quality, as long as the sensor/station is operational.

In order to save energy and thereby lengthen the network lifetime, sensors/stations may be in the sleep mode for most of the time. During the sleep mode, the receiver of a sensor/station is off and thus the sensor/station cannot receive any message from other sensors/stations or from the central unit. Therefore, in order to receive user-issued messages from the central unit, a sensor/station needs to wake up and listen to the channels regularly.

The present invention provides a scheme for IEEE802.11-based wireless security/fire systems in which sensors/stations wake-up regularly and can overhear messages from their neighboring sensors/stations. Thus, the overhearing sensors/stations may relay alarm messages to the access unit/hub from those neighboring sensors/stations that have poor channel qualities and that may be unable to independently transmit alarm messages that may be received by the access unit/hub. When it results in better performance, a sensor/station may transmit packets via a relay instead of transmitting the packets directly to the destination.

The present invention provides a method that can increase the reliability of alarm handling in security or fire alarm systems. The communication protocols of the system of the present invention may be based on the IEEE802.11 standard.

The invention comprises, in one form thereof, a method of wirelessly transmitting alarm signals, including wirelessly transmitting an alarm signal from a transmitting station. It is determined whether an acknowledgement signal wirelessly transmitted from an access point in response to the access point receiving the alarm signal has been received by the transmitting station. A relaying station is woken up and kept awake during a plurality of periodic time intervals for overhearing transmissions from the transmitting station. If it is determined that an acknowledgement signal from the access point has not been received by the transmitting station, then the alarm signal is wirelessly re-transmitting from the transmitting station during at least one of the time intervals in which the relaying station is awake. The alarm signal is received at the relaying station. The alarm signal is transmitted from the relaying station to the access point.

The invention comprises, in another form thereof, a method of wirelessly transmitting alarm signals, including wirelessly transmitting an alarm signal from a transmitting station. It is determined whether a first acknowledgement signal wirelessly transmitted from an access point in response to the access point receiving the alarm signal has been received by the transmitting station. A relaying station is maintained in an awake state during a plurality of periodic time intervals. If it is determined that a first acknowledgement signal from the access point has not been received by the transmitting station, then the alarm signal is wirelessly re-transmitted from the transmitting station during at least one of the time intervals in which the relaying station is awake. The alarm signal is received at the relaying station. The alarm signal is transmitted from the relaying station to the access point. It is determined whether a second acknowledgement signal transmitted from the access point in response to the access point receiving the alarm signal has been received by the relaying station. If it is determined that a second acknowledgement signal from the access point has not been received by the relaying station, then the alarm signal is re-transmitted from the relaying station.

The invention comprises, in yet another form thereof, a wireless network for a security system. The network includes an access point that wirelessly receives an alarm signal and wirelessly transmits an acknowledgement signal in response to receiving the alarm signal. A relaying station includes a security sensor. The relaying station periodically listens for the alarm signal, and relays the alarm signal overheard during the periodic listening, with the alarm signal being relayed to the access point. A transmitting station senses a security breach and wirelessly transmits at least one alarm signal in response to sensing the security breach. The transmitting station re-transmits the alarm signal during the periodic listening by the relaying station if an acknowledgement signal is not received from the access point. The transmitting station enters a sleep mode after receiving an acknowledgement signal.

An advantage of the present invention is that it accommodates schemes in which sensors/stations are in the power saving mode some or most of the time, and in which each sensor/station turns its transceiver on only under two conditions: 1) When the sensor/station wants to transmit to, or receive network packets from, the AP; and 2) When the sensor/station needs to relay overheard messages from other sensors/stations. Condition 2) necessitates that at certain periods the sensor/station needs to stay awake longer to overhear messages from other stations/sensors.

Another advantage of the present invention is that it enables sensors/stations to overhear network packets transmitted from other sensor/stations. Thus, the overhearing sensor/station may be able to relay the overheard network packets to the desired destination, which enables reliable operation with a possibility of reduced energy consumption, when the signal between a station/sensor and AP is weak.

Yet another advantage of the present invention is that it does not require dedicated relay stations in the network, but rather may enable all sensor/stations to relay packets for other sensor/stations.

Still another advantage of the present invention is that a station may transmit packets via both a relay and the direct path in order to increase the rate of successful transmissions, and to thereby increase the reliability of the network.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
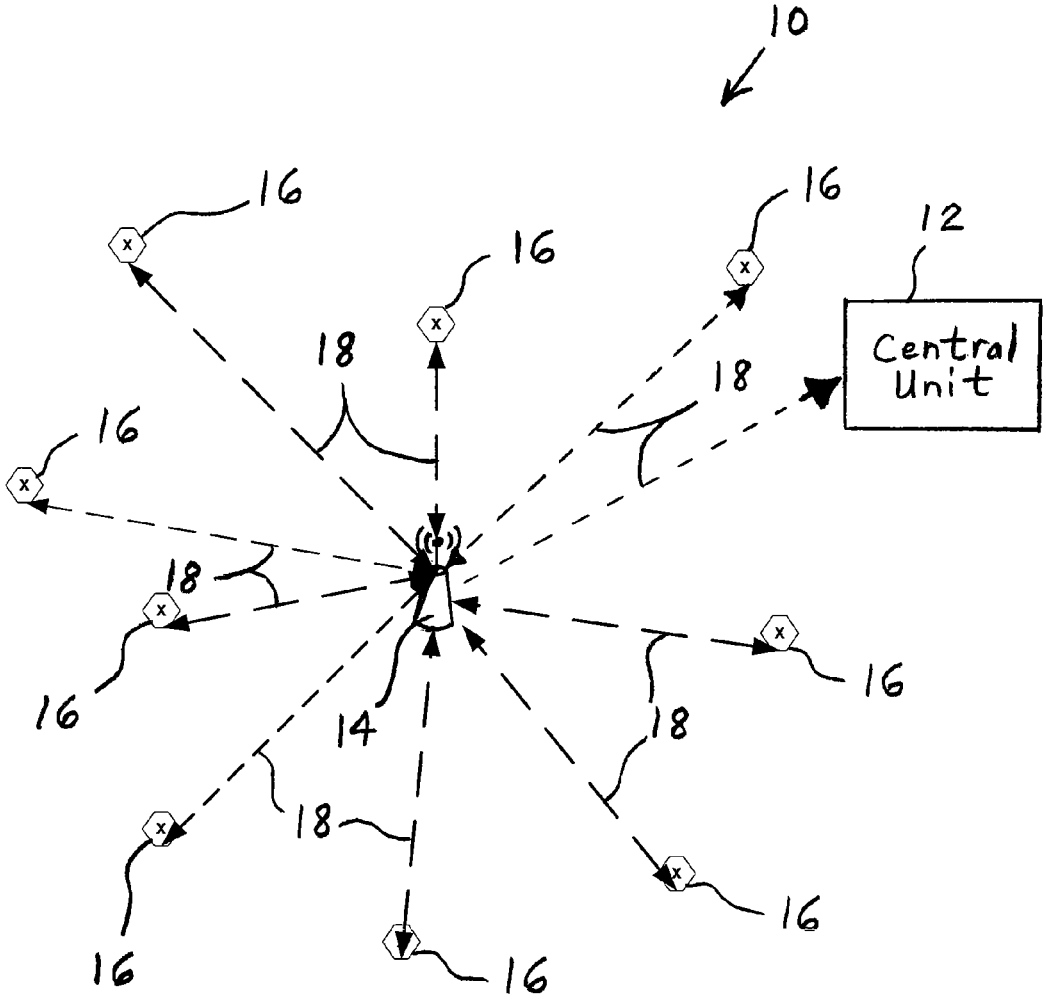
FIG. 1 is a block diagram illustrating one embodiment of a wireless sensor network of the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Referring now to the drawings, and particularly to FIG. 1, there is shown one embodiment of a wireless sensor network 10 of the present invention for security/alarm systems with two-way communication. Network 10 may include a central unit 12, an access point (AP) 14, and a group of stations 16 with sensors. Stations 16 may communicate with AP 14 via wireless channels 18. A user can issue a command to a station 16 using central unit 12, and then central unit 12 may deliver the command to the station 16 via AP 14. Each station 16 may include one or more sensors for detecting security breaches, such as the presence of smoke or a human intruder, for example. When an alarm is issued by a station 16, the alarm may then be delivered to central unit 12 through AP 14. Central unit 12 and AP 14 may be AC-powered, while stations 16 may be battery-powered.

In order to have long network lifetimes, all stations 16 may be in the sleep mode for most of the time to thereby save energy. During the sleep mode, the receiver of a station 16 may be off and that station 16 may not be able to receive any message from other stations 16 or from central unit 12. Therefore, in order to receive user-issued messages from central unit 12, a station 16 may need to wake up and listen to the channel periodically, e.g., at regular intervals.

In the IEEE 802.11 standard, a station can stay in a type of sleep mode referred to as a "Power Save (PS) mode" to save energy. If a station in the PS mode, it turns on its radio only when necessary. Hence it cannot receive any packet during the sleep mode. If the AP has packets to send but the destination station is in sleep mode, then the AP may first buffer the packets in its memory. The AP broadcasts beacon signals periodically, and when there are packets buffered, the AP sends Traffic Indication Map (TIM) messages in the beacons. If the destination station happens to wake up and receive that beacon, the destination station then later sends a PS-Poll to the AP and requests the AP to send the buffered packets to the station.

According to the present invention, it may be assumed that all stations 16 (also referred to as "nodes") can talk to an Access Point (AP) 14 directly when the station's transmitter is on and the channel condition is good. It may be further assumed that a station 16 might be able to "overhear" another station's transmissions if those two stations are in communication range.

The invention includes several novel features. First, stations 16 are generally in sleep mode. After stations 16 wake up and receive the beacon signal of AP 14, stations 16 stay in wake-up mode for a while to overhear their neighboring stations' transmissions if any. Second, a station 16 can use neighboring stations 16 to relay its messages to AP 14 while the neighboring stations wake up. Third, the overhearing relay method can increase network reliability.

With regard to alarm handling, alarm messages may be rarely generated, but once an alarm message is generated, it may be desirable to deliver the message to a central unit 12 as soon as possible. Therefore, the low latency and high reliability may be two important requirements for alarm handling.

If a station 16 generates an alarm, the station 16 can send the alarm based on the 802.11 standard (CSMA/CA). The station 16 may stop sending the alarm after station 16 receives an acknowledgment from the central unit 12 indicating that the alarm is received successfully (or the maximum number of retries of sending the alarm has been reached).

With regard to a wake-up-overhear-relay method of the present invention, in an 802.11 network, a station can overhear its neighbors' transmissions. Based on that, a wake-up-overhear-relay method of the invention may increase the reliability of alarm transmissions.

Figure 2:
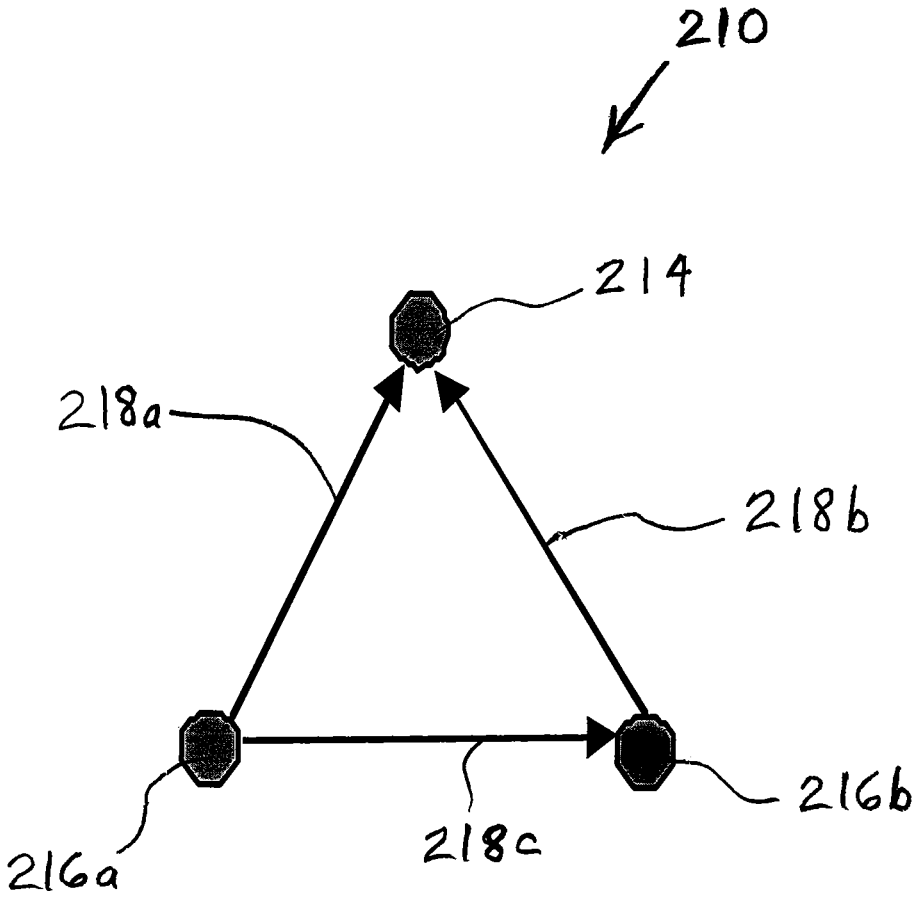
FIG. 2 is a schematic diagram of a simple embodiment of a wireless network of the present invention in which if a link between a first station and an AP degrades, then a neighboring second station can relay the first station's messages to the AP.

With reference to network 10 (FIG. 1), any of stations 16 may send alarm messages to AP 14 directly. However, if the link between a particular station 16 and AP 14 temporarily degrades or disconnects, then any of the other stations 16 may be able to relay the particular station's alarm messages if any of the other stations 16 can overhear the particular station's transmission. Network 210 (FIG. 2), including one AP 214 and two stations 216*a* and 216*b*, illustrates this feature. Normally, stations 216*a* and 216*b* send alarm messages to AP 214 directly, as indicated by links 218*a* and 218*b*, respectively. However, if link 218*a* between station 216*a* and AP 214 temporarily degrades or disconnects, then station 216*b* may be able to relay station 216*a*'s alarm messages to AP 214 on link 218*b* if station 216*b* can overhear station 216*a*'s transmission, as indicated at 218*c*.

Station 216*a* may be referred to herein as a "transmitting station", and station 216*b* may be referred to herein as a "relaying station." However, it is to be understood that where these two terms are used herein, the terms may describe only the tasks being performed by the stations in a particular situation, and should not be construed as describing any limitations on the stations' structure or functionality. That is, a "transmitting station" and a "relaying station" may be substantially identical both physically and functionally. In another situation, a "relaying station" may sense a security breach and originate and transmit an alarm signal. Further, a "transmitting station" may relay to an access point an alarm signal received from a "relaying station."

Figure 3:
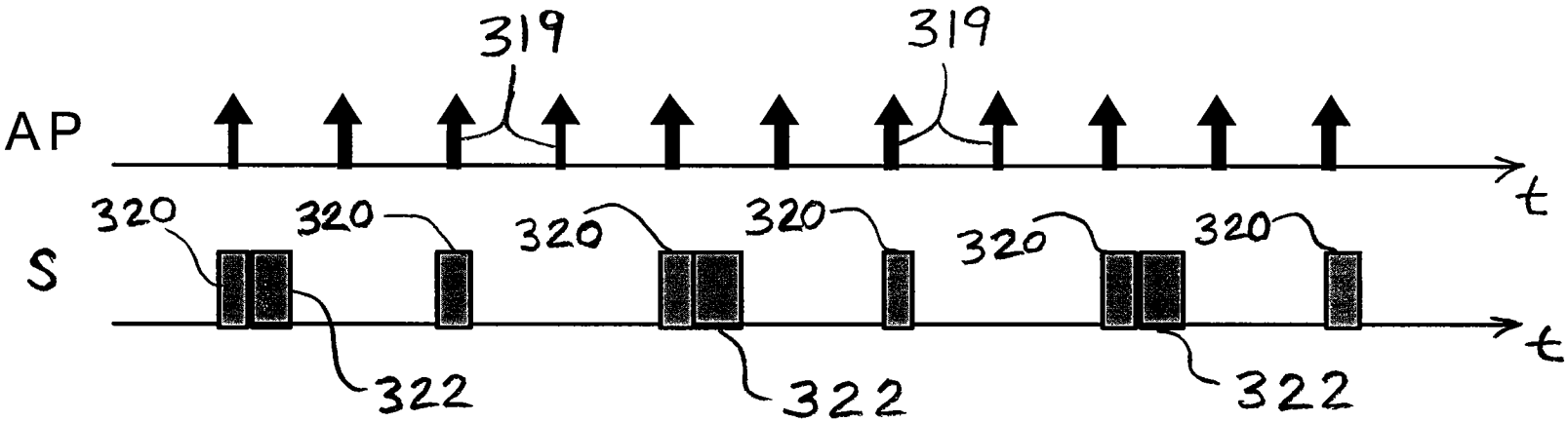
FIG. 3 is timing diagram illustrating one embodiment of a method of the present invention in which a relaying station stays awake for a longer period of time in some instances, if needed, in order to relay messages from a transmitting station.

In one embodiment of a network of the invention, in order to have a longer network lifetime, the stations are required to stay in the power saving mode when there is no transmission taking place. However, in order to apply overhearing, a station may be required to stay awake and remain listening to channels for a longer period of time. As illustrated in FIG. 3, a station S periodically wakes up and listens to the beacons 319 from the AP, as indicated at 320. In some of the wake up intervals (e.g., every other wake up interval in the embodiment of FIG. 3), station S stays awake longer (e.g., for an extra time period 322) and continues to listen to the channel. If a transmitting station wants to use station S as a relay, then the transmitting station may send an alarm signal during a time period in which the transmitting station knows that station S is overhearing, such as during time periods 322.

As can be seen from FIG. 3, the frequency at which beacon signals 319 are issued may be greater than a frequency at which station S listens for beacons 319, as indicated at 320. Further, the frequency at which station S listens for beacons 319, as indicated at 320, may be greater than a frequency at which station S stays awake for an extra time period 322. Thus, beacon signals may be periodically transmitted from the access point with a frequency that is greater than a frequency at which the relaying station listens for signals from the transmitting station during periodic time intervals 322.

Figure 4:
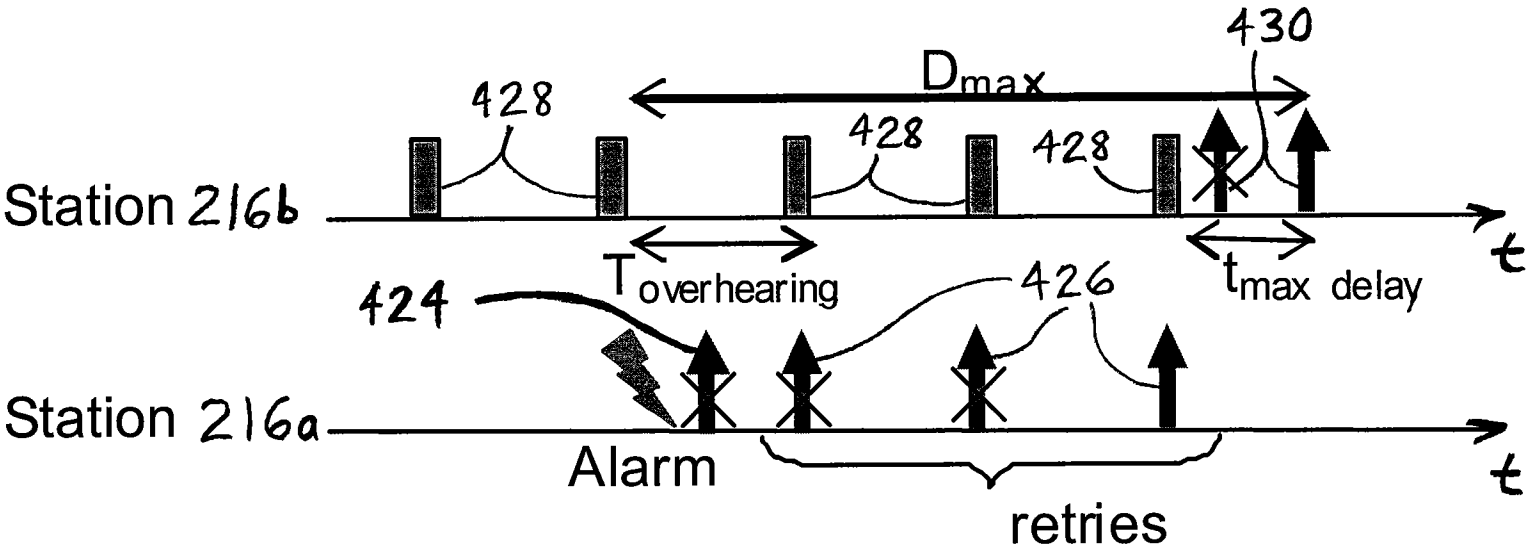
FIG. 4 is a timing diagram illustrating one embodiment of communication between the first station and the second station of FIG. 2.

FIG. 4 illustrates the communication between stations 216*a* and 216*b* over a timeline. When station 216*a* has an alarm message to send, station 216*a* sends the alarm message as soon as possible, as indicated by arrow 424. If the alarm message does not go through and get received successfully, e.g., no acknowledgment signal is received by station 216*a* or an acknowledgment signal received by station 216*a* indicates there is an error, then station 216*a* retries sending the alarm message when station 216*b* is overhearing. In the specific example shown in FIG. 4, station 216*a* retries sending the alarm message multiple times, as indicated at 426, during corresponding time periods 428 in which station 216*a* knows that station 216*b* is overhearing. In the example of FIG. 4, the first two retries 426 fail, as indicted by the crosses through the arrows, and station 216*b* does not receive the alarm message. After that, the third retry 426 succeeds in getting through and in being received. In response to receiving/overhearing the alarm message on third retry 426, station 216*b* tries to relay the alarm message, as indicated at 430, to AP 214. Station 216*b* tries to relay the alarm message to AP 214 several times as soon as possible. As indicated in FIG. 4 by the cross through the first arrow 430, the first attempted relay of the alarm message from station 216*b* to AP 214 fails, but the second attempt represented by the second arrow 430 is successful.

Figure 5:
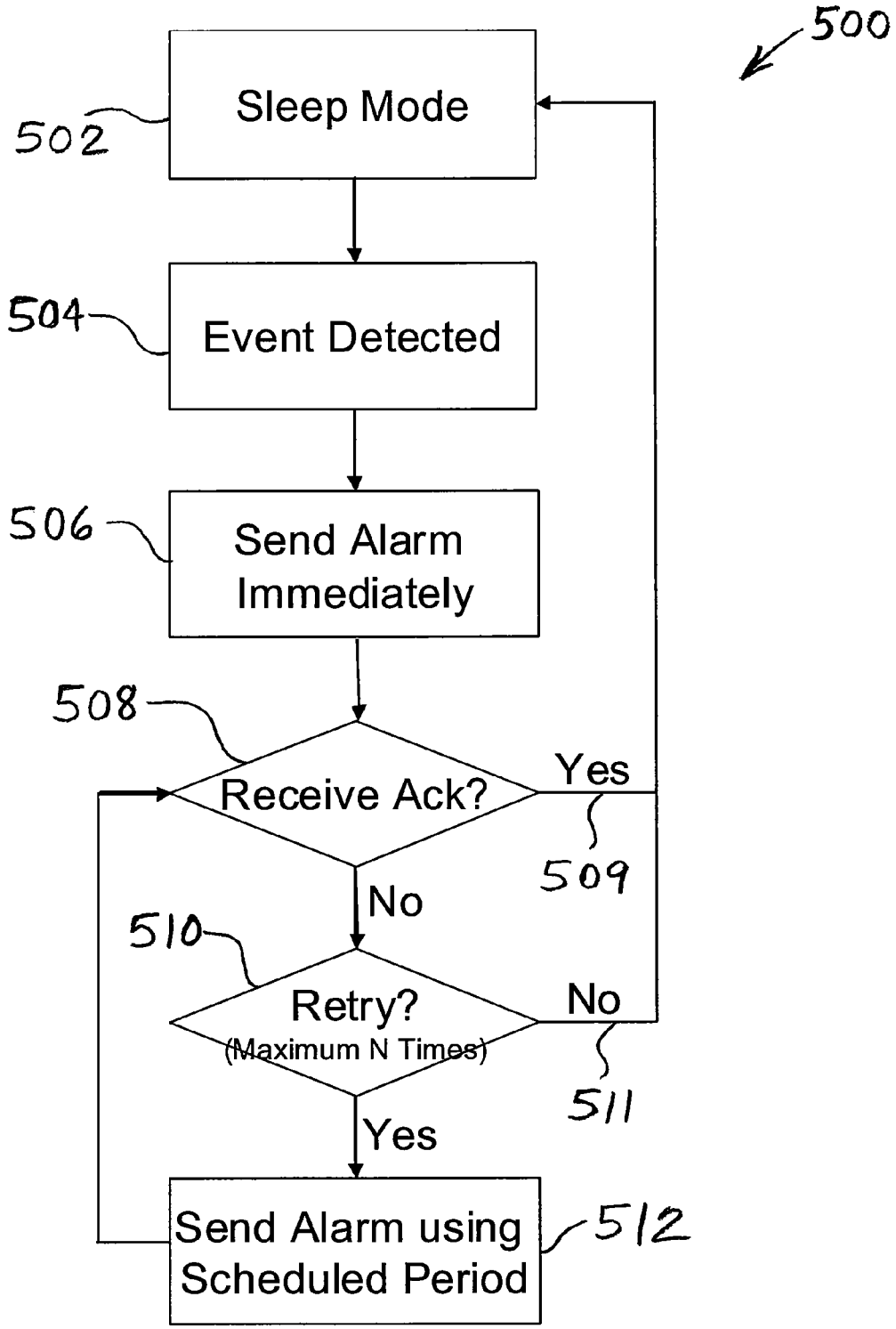
FIG. 5 is a flow chart of the communication process for the first station of FIG. 2 according to one embodiment of the present invention.

FIG. 5 is a flow chart of one embodiment of a communication process 500 for transmitting station 216*a*. In a first step 502, transmitting station 216*a* begins the process in a sleep mode. In a second step 504, transmitting station 216*a* detects an event of which station 216*a* needs to inform AP 214. For example, station 216*a* may detect the presence of smoke or an intruder. In a next step 506, station 216*a* immediately transmits an alarm signal to AP 214, as at 424. Next, in step 508, station 216*a* determines whether it has received an acknowledgement signal in response to the transmission of the alarm signal. If so, then station 216*a* re-enters the sleep mode, as indicated at 509. If not, station 216*b* decides in step 510 whether it should retry by sending the alarm signal to relay station 216*b*, e.g., depending upon whether the maximum number of retries N has been attempted. If the maximum number of retries has indeed been attempted, then operation returns to step 502, as indicated at 511. If, however, the maximum number of retries has not been attempted, then station 216*a* re-transmits the alarm signal (step 512) as at 426 during time periods 428 in which station 216*b* is listening. Next, returning to step 508, station 216*a* determines whether it has received an acknowledgement signal from AP 214 in response to station 216*b* relaying the alarm signal. If so, then station 216*a* re-enters the sleep mode (step 502), as indicated at 509. If not, then station 216*a* again determines in step 510 whether it should retry by sending the alarm signal to relay station 216*b*, and the process continues as described above.

Figure 6:
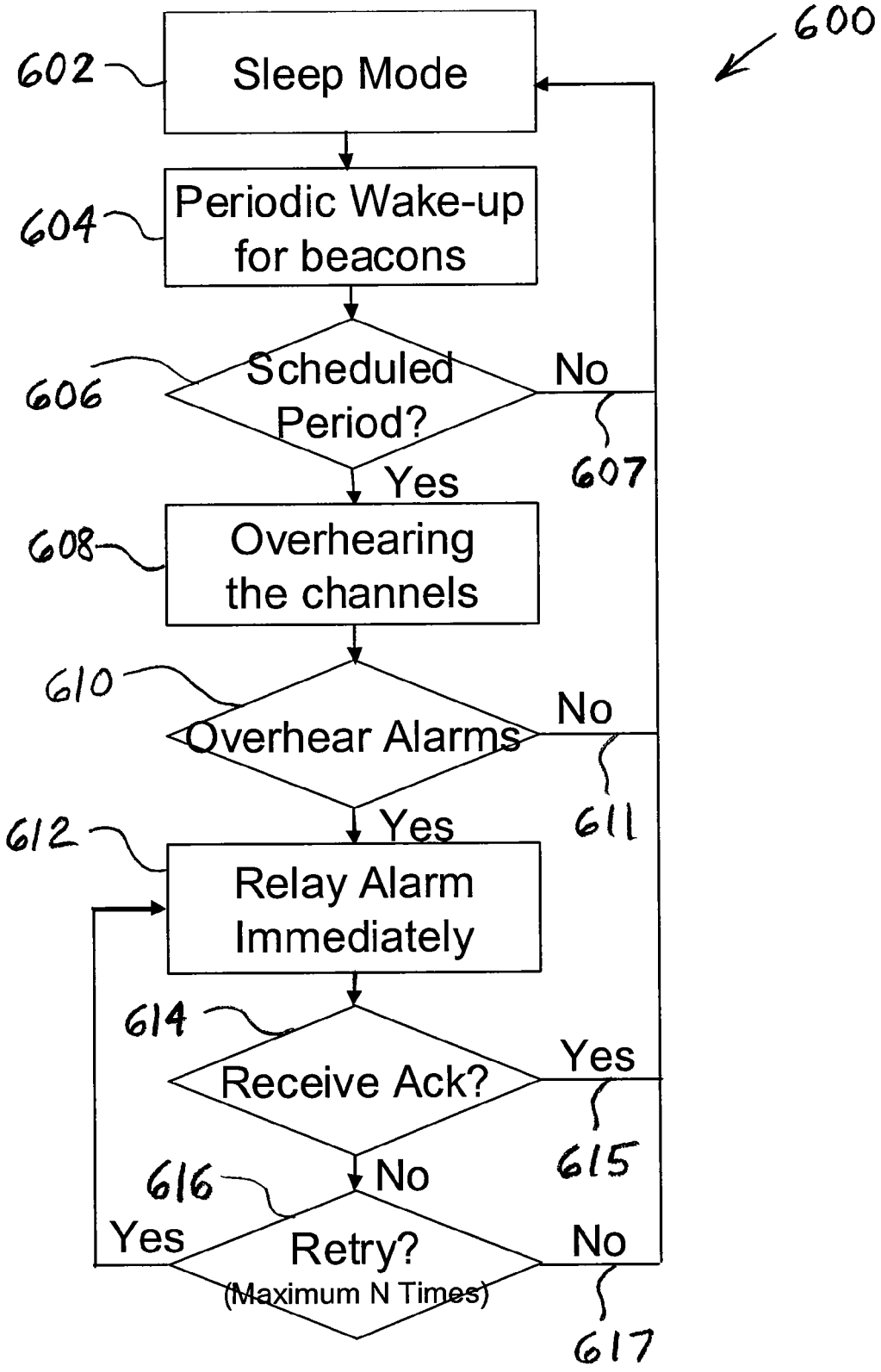
FIG. 6 is a flow chart of the communication process for the second station of FIG. 2 according to one embodiment of the present invention.

FIG. 6 is a flow chart of one embodiment of a communication process 600 for relaying station 216*b*. In a first step 602, relaying station 216*b* begins the process in a sleep mode. In a second step 604, relaying station 216*b* periodically wakes up and listens for beacons from AP 214, as indicated at 428. In a next step 606, it is determined whether the current time is within one of the scheduled time periods 428. If not, station 216*b* remains in, or returns to, the sleep mode, as indicated at 607. If, however, it is determined in step 606 that the current time is indeed within one of the scheduled time periods 428, then station 216*b* performs the act of listening in on, or overhearing on, one or more designated channels (step 608). These may be channels on which alarm signals are relayed, as known by station 216*b*, for example. In step 610, it is determined whether station 216*b* has overheard an alarm signal during time period 428. If not, then operation returns to the sleep mode, as indicated at 611. If, however, it is determined in step 610 that station 216*b* has indeed overheard an alarm signal during time period 428, then station 216*b* immediately relays the alarm signal to AP 214, as indicated at 430 (step 612). Next, in step 614, station 216*b* determines whether station 216*b* has received an acknowledgement signal from AP 214. If so, then station 216*b* may return to the sleep mode (step 602), as indicated at 615. If, on the other hand, it is determined in step 614 that station 216*b* has not received an acknowledgement signal from AP 214, then it is determined in step 616 whether station 216*b* should retry relaying the alarm signal to AP 214. That is, it is determined whether station 216*b* has already retried to relay the alarm signal to AP 214 the maximum number of times. If it is determined in step 616 that station 216*b* has indeed already retried to relay the alarm signal to AP 214 the maximum number of times (and should not retry), then station 216*b* may return to the sleep mode (step 602), as indicated at 617. If, however, it is determined in step 616 that station 216*b* has not retried to relay the alarm signal to AP 214 the maximum number of times (and should indeed retry), then station 216*b* may return to step 612 wherein station 216*b* may again attempt to relay the alarm signal to AP 214.

The performance of the simple example network 210 (FIG. 2) may be determined. First, the error rate may be calculated. The error rate of a link from station i to station j may be denoted as $P_{ij}$, where the values of $P_{ij}$ for various stations i and j are independent of each other. Given the maximum number of retries N, the probability that an alarm fails to be transmitted from station B to the AP is $P_{BC}^{N+1}$, and the probability that an alarm fails to be transmitted from station B to station C (the relaying station) and then to the AP is given by $$P_{BCA}=(1-P_{BC})*(P_{CA}^{N}P_{BC}*P_{CA}^{N-1}+P_{BC}^{2}*P_{CA}^{N-2}+\ldots+P_{BC}^{N-1}*P_{CA}^{1})+P_{BC}^{N}.$$

Therefore, the probability that an alarm fails to be transmitted from station B to station C to AP or from station B to AP is given by $$P_f=P_{BC}^{N+1}*P_{BCA}.$$

Figure 7:
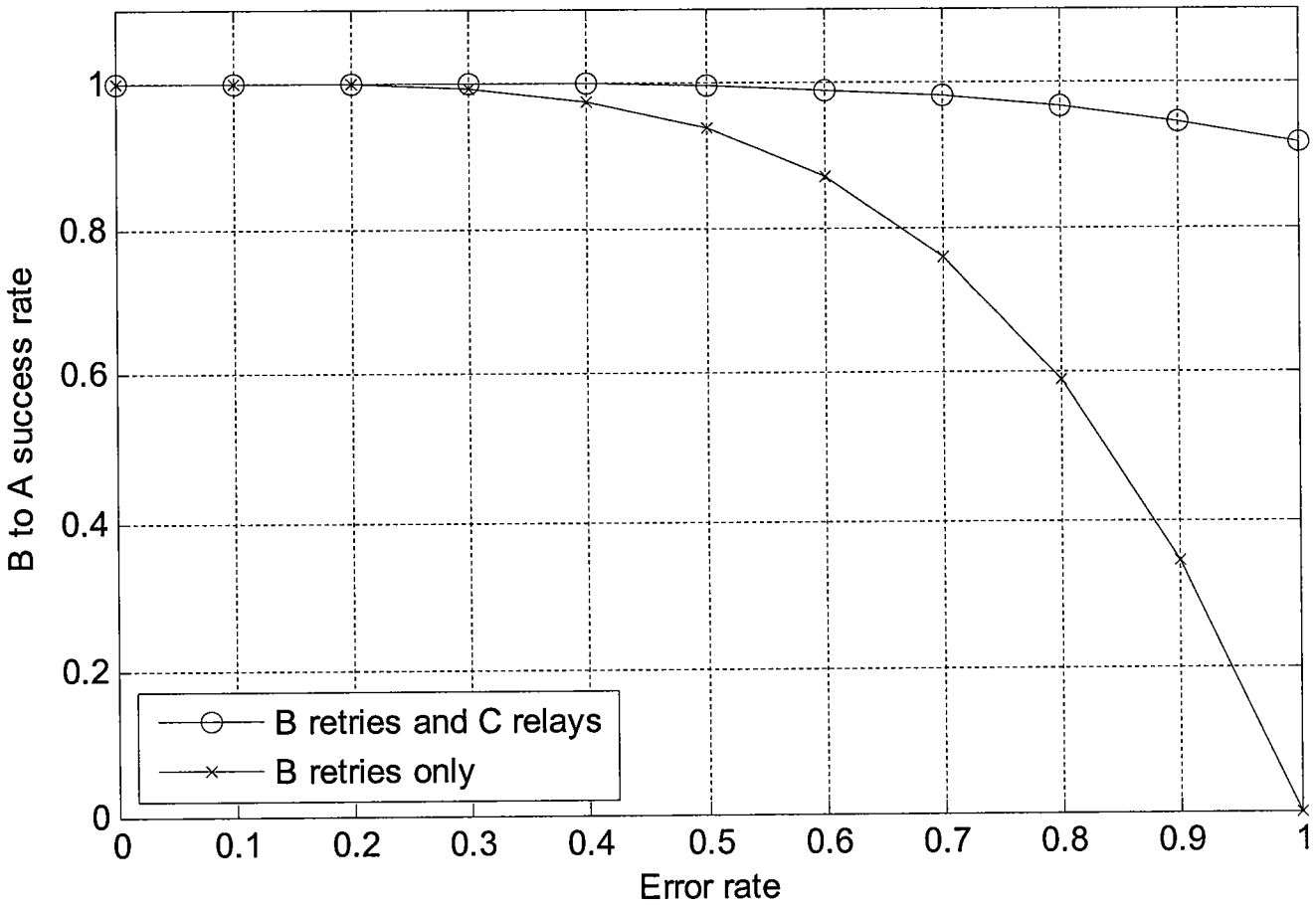
FIG. 7 is an example plot of the success rate of messages to an access point/central unit versus the error rate of a communication channel between a transmitting station and an access point/central unit.

Let N=3, and $P_{BC}=P_{CA}=0.3$. The performance of the case where only station B tries to transmit the alarm messages (probability of success=$1-P_{BC}^{N+1}$) may be compared to the case where station C can overhear the alarms from station B and relay it (probability of success=$1-P_f$). The result is plotted in FIG. 7 as the final success rate of A receiving B's message ($1-P_f$ and $1-P_{BC}^{N+1}$) as a function of the error rate $P_{BA}$. As can be seen from the two plots provided in FIG. 7, the probability of success is much greater, particularly at higher error rates, when B retries and C relays than when B retries only. That is, it can be observed that, by the overhearing relay method of the invention, a high success transmission rate can be achieved even when the link between the transmitting station and the AP has a high error rate.

On the other hand, the maximum delay ($D_{max}$; FIG. 4) for the overhearing relay scheme may be given by $$D_{max}=T_{overhearing}*N+t_{max_delay}$$

where $T_{overhearing}$ is the overhearing period of a station (in the example of FIG. 2, relaying station 216*b*), and $t_{max_delay}$ is the maximum delay of transmitting a package from a station to the AP when the channel is perfect but the delay is due to contention. The following equation may be further obtained for the overhearing period:

$$T_{overhearing}=E_O/P_O,$$

where $E_O$ is the energy used for overhearing, and $P_O$ is defined as the overhearing power.

Figure 8:
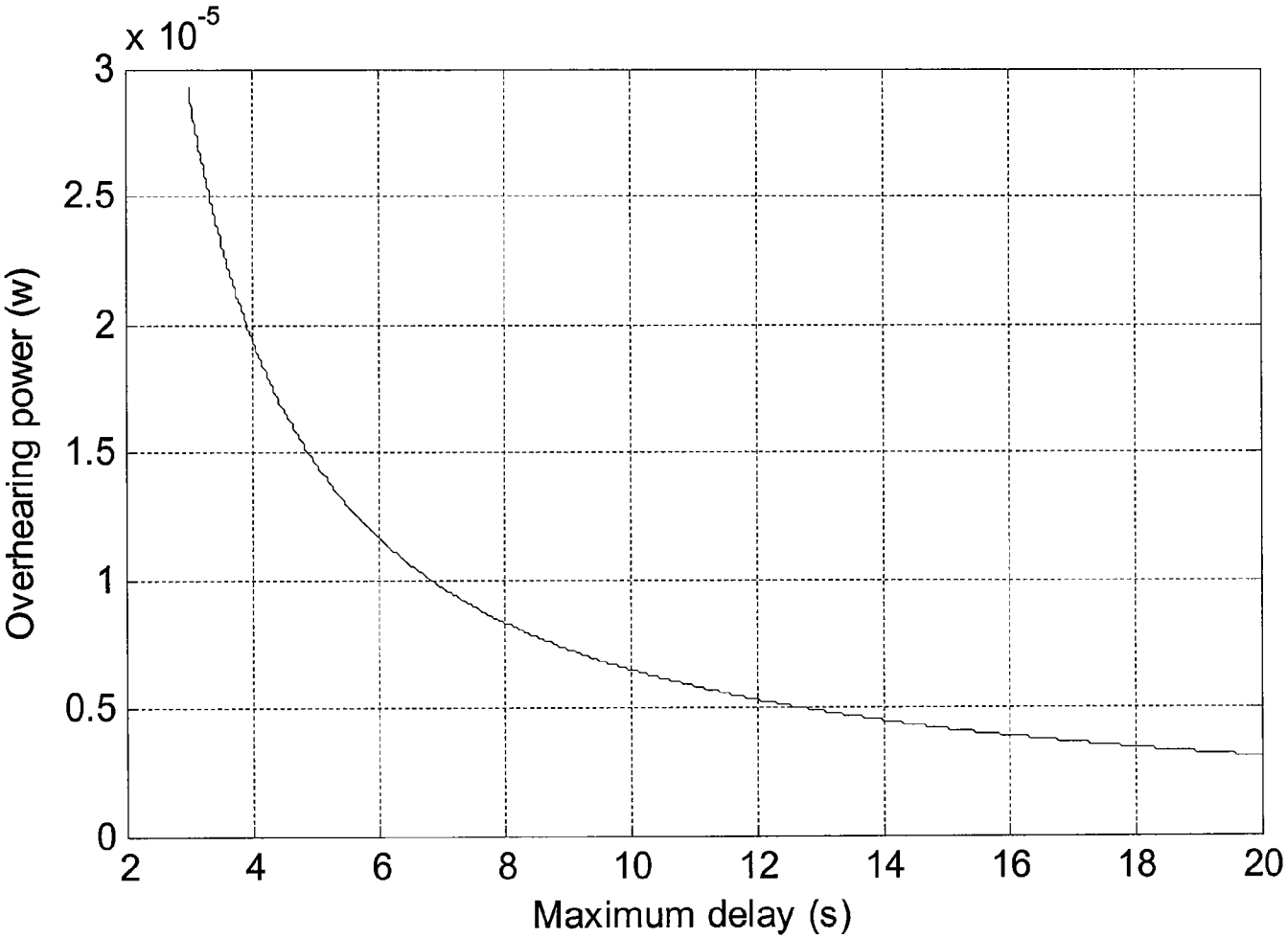
FIG. 8 is an example plot of a trade-off between overhearing power and a maximum delay.

Given $E_O$=19.5 uJ, N=3, and $t_{max_delay}$=1 second, the trade-off between the overhearing power ($P_O$) and the maximum delay ($D_{max}$) may be plotted, as shown in FIG. 8. The trade-off curve shows that the more often a station overhears the channels the greater the power that the station spends, but the less the delay. That is, the frequency at which a station overhears the channels may be directly related to the power that the station spends, and inversely related to the delay.

Figure 9:
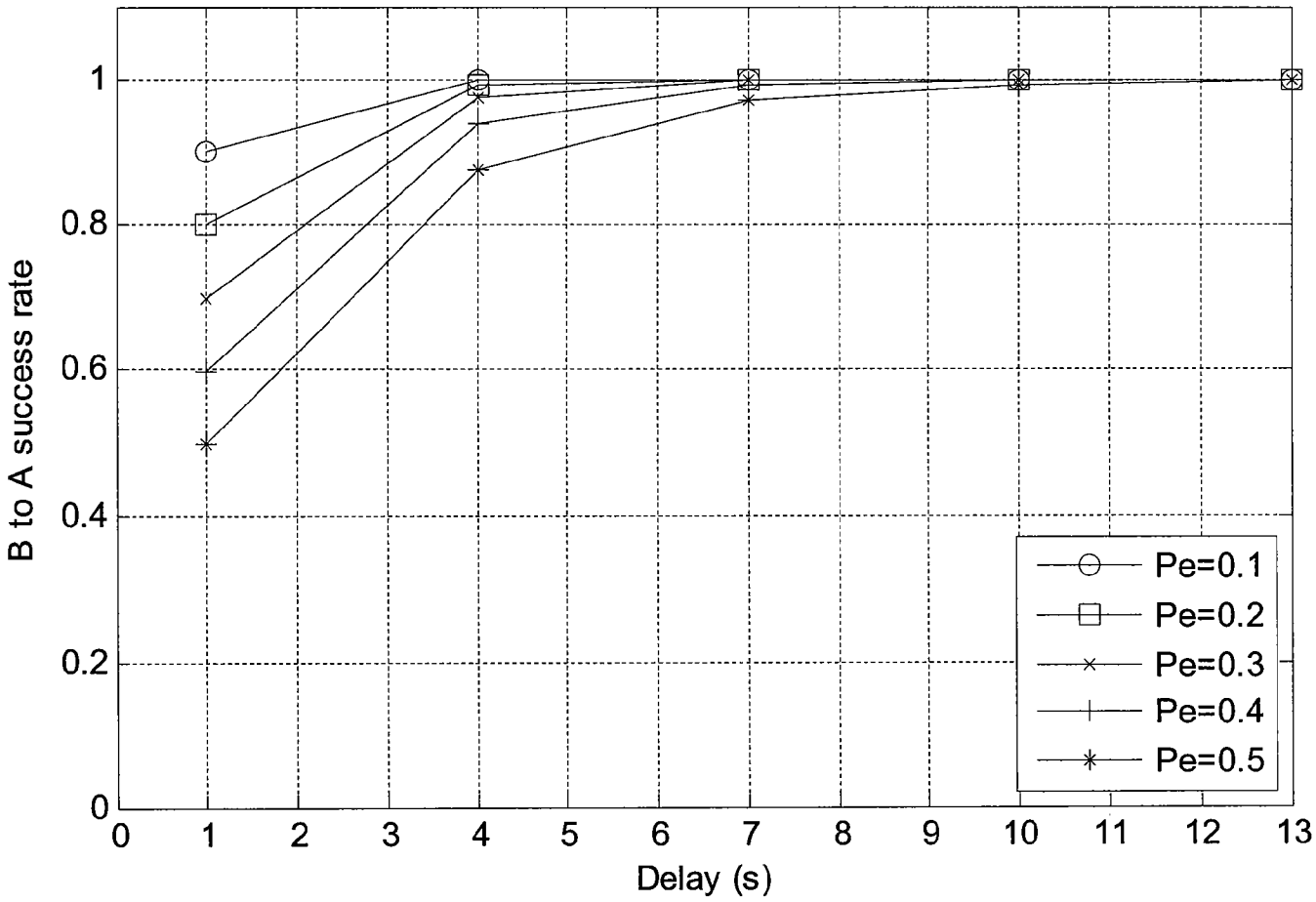
FIG. 9 is an example plot of the success rate of messages from a transmitting station to an access point/central unit versus the maximum delay.

Given $P_{BA}=P_{BC}=P_{CA}=P_e$ and $t_{max_delay}$=1 second, the final success rate ($1-P_f$) may be plotted as a function of the maximum delay ($D_{max}$), as shown in FIG. 9. Because stations may need to stay awake for longer periods of time in order to overhear according to the invention, there may be an effect on energy consumption. Given the hardware parameters (e.g., radio power consumption, battery capacity), the impact on the network lifetime may be calculated.

The overhearing relay method may be especially useful when the link between a station and the AP is broken temporarily. In this case, a transmitting station can use other stations as a relay and pass the transmitting station's alarm messages on to the AP within desired time limits and parameters.

There may be two ways in which the performance of the overhearing relay method may be further improved. First, more than one station may be used to relay the alarm messages from each transmitting station. This may increase the reliability of the system but may decrease the lifetime. Second, the stations may be partitioned into different groups using the method described in "Wakeup Scheduling in Wireless Sensor Networks," by A. Keshavarzian, H. Lee, L. Venkatraman, D. Lai, K. Chintalapudi, and B. Srinivasan, Proc. Of the ACM International Symposium on Mobile Ad Hoc Networking and Computing, Florence, Italy, May 2006, and in European Patent Publication 1780951, entitled "Node Control Using Crossed Ladder Pattern in Wireless Sensor Networks," by A. Keshavarzian, L. Venkatraman and H. Lee, 2007, each of which is hereby incorporated by reference herein in their entireties. Each station group created by this method may perform overhearing alternatively, or on an alternating basis. In this embodiment, each group of stations may spend less power on overhearing but the delay may not be increased.

The invention includes several novel features. First, stations may normally be in power saving mode. After relaying stations wake up and receive beacon signals from the access point, the relaying stations stay in wake-up mode for an extended period in order to overhear transmissions, if any, from their neighboring stations. Second, a transmitting station can use neighboring stations to relay the transmitting station's messages to the access point while the neighboring stations are awake. Third, the overhearing relay method can increase network reliability by increasing the rate of successful reception of the transmitting station's message by the access point.

Figure 10:
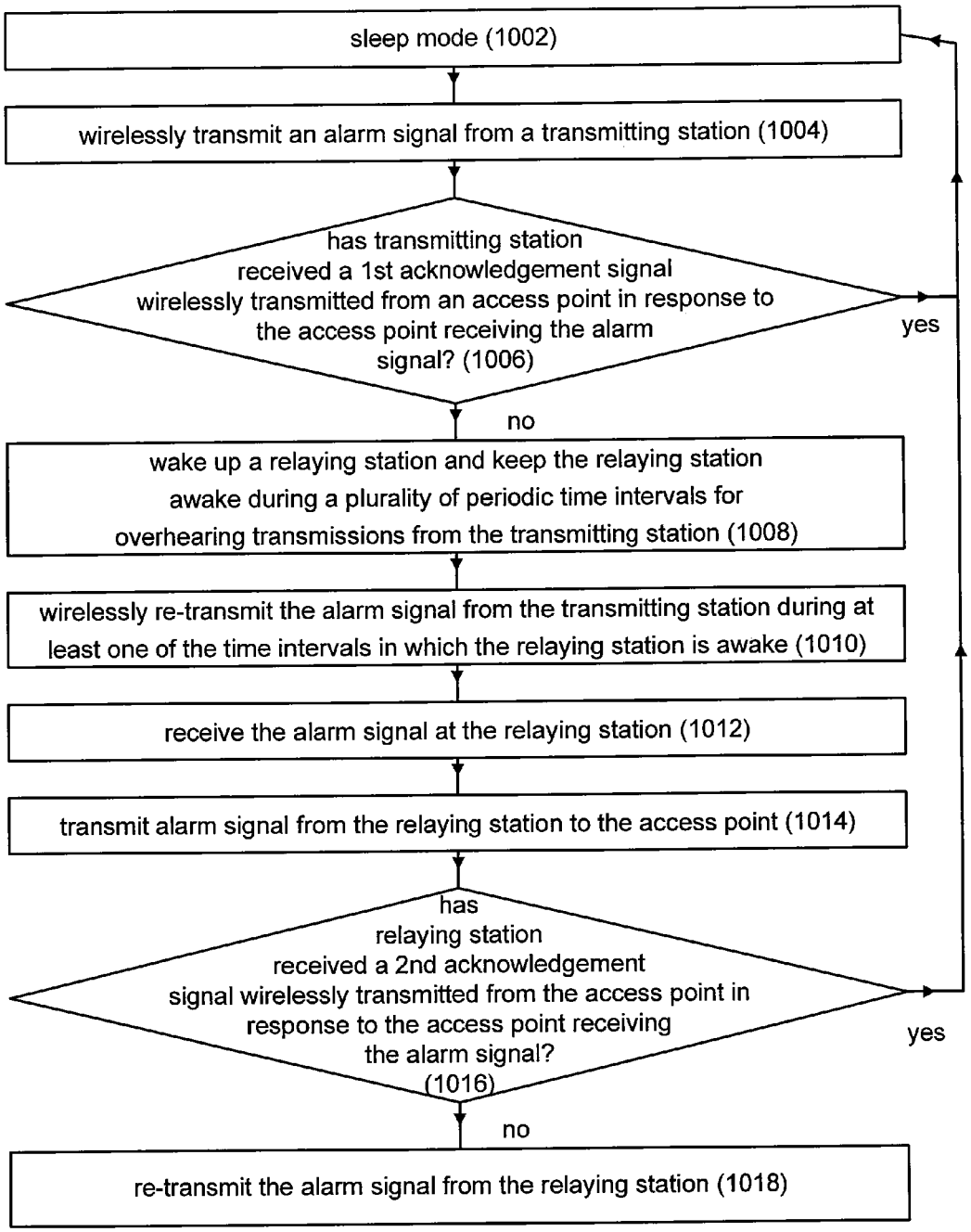
FIG. 10 is a flow chart of one embodiment of a method of the present invention for wirelessly transmitting alarm signals.

One embodiment of a method 1000 of the present invention for wirelessly transmitting alarm signals is illustrated in FIG. 10. In a first step 1002, operation begins in a sleep mode. For example, both a transmitting station 216*a* and a relaying station 216*b* may be in a sleep mode or "power-saving" mode in which the station may reduce to a minimum the rate of energy consumption from its battery in order to thereby lengthen the battery's lifetime.

In a next step 1004, an alarm signal is wirelessly transmitted from a transmitting station. That is, transmitting station 216*a* may include a security sensor such as a smoke sensor or an infrared motion detector, for example. Upon the security sensor detecting a security breach, such as the presence of smoke or of motion, station 216*a* may wirelessly transmit an alarm signal, as indicated at 424, which is intended to be received by access point 214 and passed on by access point 214 to a central controller, such as central unit 12. The central controller may then evaluate whether the alarm signal is indicative of an actual security breach, and, if so, may notify via land-based telephone lines an appropriate responding authority, such as a fire department or police station, for example.

Next, in step 1006, it is determined whether the transmitting station has received a first acknowledgement signal that has been wirelessly transmitted from the access point in response to the access point receiving the alarm signal. For example, after access point 214 has received the wireless alarm signal from transmitting station 216*a*, access point 214 may respond by wirelessly transmitting an acknowledgement signal in order to thereby notify transmitting station 216*a* that the alarm signal has been received by access point 214. If, however, access point 214 does not receive the alarm signal, which may be due to a poor quality communication link 218*a* between station 216*a* and access point 214, for example, then transmitting station 216*a* will not receive the acknowledgement signal. If transmitting station 216*a* has received the acknowledgement signal from access point 214, then transmitting station 216*a* may go back into the sleep mode. If, however, transmitting station 216*a* has not received the acknowledgement signal from access point 214, then operation proceeds to step 1008.

In step 1008, the relaying station is woken up and kept awake during a plurality of periodic time intervals for overhearing transmissions from the transmitting station. For example, as best shown in FIG. 3, station S is woken up as indicated at 320, and is kept awake during the periodic time intervals 322 so that station S may be able to overhear transmissions from a transmitting station. It is to be understood that when "waking up the relaying station" or similar language is used herein, it includes the possibility that the relaying station wakes itself up.

In a next step 1010, the alarm signal is wirelessly re-transmitted from the transmitting station during at least one of the time intervals in which the relaying station is awake. That is, transmitting station 216*a* may wirelessly re-transmit an alarm signal as indicated at 426 during time intervals 428 in which station 216*b* is awake.

Next, in step 1012, the alarm signal is received at the relaying station. For example, the final or right-most arrow 426 in FIG. 4 does not have a cross through it in order to indicate that the alarm signal was successfully received by relaying station 216*b*.

In a next step 1014, the alarm signal is transmitted from the relaying station to the access point. That is, as indicated by arrows 430 in FIG. 4, an alarm signal is transmitted from relaying station 216*b* to access point 214.

Next, in step 1016, it is determined whether the relaying station has received a second acknowledgement signal that has been wirelessly transmitted from the access point in response to the access point receiving the alarm signal. For example, after access point 214 has received the wireless alarm signal from relaying station 216*b*, access point 214 may respond by wirelessly transmitting an acknowledgement signal in order to thereby notify relaying station 216*b* that the alarm signal has been received by access point 214. If, however, access point 214 does not receive the alarm signal, which may be due to a poor quality communication link 218*b* between station 216*b* and access point 214, for example, then relaying station 216*b* will not receive the acknowledgement signal. If relaying station 216*b* has received the acknowledgement signal from access point 214, then relaying station 216*b* may go back into the sleep mode. If, however, relaying station 216*b* has not received the acknowledgement signal from access point 214, then operation proceeds to step 1018.

In the final step 1018, the alarm signal is re-transmitted from the relaying station. That is, relaying station 216*b* may re-transmit the alarm signal as indicated by the second or right-most arrow 430 in FIG. 4 if no acknowledgement signal is received as a result of the first alarm signal indicated by the first or left-most alarm arrow 430. Relaying station 216*b* may continue to re-transmit the alarm signal a number of times, stopping only if an acknowledgement signal is received. However, if the relaying station has not received the acknowledgement from access point 214 after re-transmitting the alarm signal N number of times, then the relaying station may give up and may go to sleep.

While this invention has been described as having an exemplary design, the present invention may be further modified within the spirit and scope of this disclosure. This application is therefore intended to cover any variations, uses, or adaptations of the invention using its general principles.

What is claimed is:

1. A method of wirelessly transmitting alarm signals, comprising the steps of: wirelessly transmitting an alarm signal from a transmitting station; determining whether an acknowledgement signal has been received by the transmitting station, wherein the acknowledgement signal has been wirelessly transmitted from an access point in response to the access point receiving the alarm signal; waking up a relaying station and keeping the relaying station awake during a plurality of periodic time intervals for overhearing transmissions from the transmitting station; if it is determined that an acknowledgement signal from the access point has not been received by the transmitting station, then wirelessly re-transmitting the alarm signal from the transmitting station during at least one of the time intervals in which the relaying station is awake; receiving the alarm signal at the relaying station; and transmitting the alarm signal from the relaying station to the access point, using the relaying station to sense a security breach; wirelessly transmitting at least one said alarm signal from the relaying station in response to sensing the security breach; using the transmitting station to periodically listen for said alarm signal; and using the transmitting station to relay said alarm signal overheard during the periodic listening, the alarm signal being relayed to the access point, wherein the access point is an IEEE 802.11 based hub for interfacing with an alarm network.

2. The method of claim 1 wherein if it is determined that an acknowledgement signal from the access point has been received by the transmitting station, then the transmitting station enters a sleep mode.

3. The method of claim 1 comprising the further steps of: determining whether an acknowledgement signal transmitted from the access point in response to the access point receiving the alarm signal has been received by the relaying station; and if it is determined that an acknowledgement signal from the access point has not been received by the relaying station, then re-transmitting the alarm signal from the relaying station.

4. The method of claim 1 wherein the relaying station listens for signals from the transmitting station during the periodic time intervals.

5. The method of claim 1 wherein if it is determined that an acknowledgement signal from the access point has been received by the relaying station, then the relaying station enters a sleep mode.

6. The method of claim 1 comprising the further step of periodically waking up the relaying station to listen for signals from the transmitting station at a frequency that is greater than a frequency at which beacon signals are transmitted from the access point.

7. A method of wirelessly transmitting alarm signals, comprising the steps of: wirelessly transmitting an alarm signal from a transmitting station; determining whether an acknowledgement signal wirelessly transmitted from an access point in response to the access point receiving the alarm signal has been received by the transmitting station; maintaining a relaying station in an awake state during a plurality of periodic time intervals, which are multiples of beacon periods;

if it is determined that a first acknowledgement signal from the access point has not been received by the transmitting station, then wirelessly re-transmitting the alarm signal from the transmitting station during at least one of the time intervals in which the relaying station is awake; receiving the alarm signal at the relaying station; transmitting the alarm signal from the relaying station to the access point; determining whether an acknowledgement signal transmitted from the access point in response to the access point receiving the alarm signal has been received by the relaying station; and if it is determined that an acknowledgement signal from the access point has not been received by the relaying station, then re-transmitting the alarm signal from the relaying station, using the relaying station to sense a security breach; wirelessly transmitting at least one said alarm signal from the relaying station in response to sensing the security breach; using the transmitting station to periodically listen for said alarm signal; and using the transmitting station to relay said alarm signal overheard during the periodic listening, the alarm signal being relayed to the access point, wherein the access point is an IEEE 802.11 based hub for interfacing with an alarm network.

8. The method of claim 7 wherein the relaying station is awakened to commence each said periodic time interval.

9. The method of claim 7 wherein the relaying station listens for signals from the transmitting station during the periodic time intervals.

10. The method of claim 7 comprising the further step of entering the relaying station into a sleep mode if it is determined that a second acknowledgement signal from the access point has been received by the relaying station.

11. The method of claim 7 wherein if it is determined that an acknowledgement signal from the access point has been received by the transmitting station, then the transmitting station enters a sleep mode.

12. The method of claim 7 comprising the further step of periodically waking up the relaying station to listen for signals from the transmitting station at a frequency that is greater than a frequency at which beacon signals are transmitted from the access point.

13. A wireless network for a security system, the network comprising: an access point configured to wirelessly receive an alarm signal and to wirelessly transmit an acknowledgement signal in response to receiving the alarm signal; a relaying station including a security sensor, the relaying station being configured to: periodically listen for said alarm signal; and relay said alarm signal overheard during the periodic listening, the alarm signal being relayed to the access point; and a transmitting station configured to: sense a security breach and wirelessly transmit at least one said alarm signal in response to sensing the security breach; re-transmit the alarm signal during the periodic listening by the relaying station if an acknowledgement signal is not received from the access point; and enter a sleep mode after receiving an acknowledgement signal, wherein the relaying station is also configured to sense a security breach and wirelessly transmit at least one said alarm signal in response to sensing the security breach, and the transmitting station is also configured to: periodically listen for the alarm signal; and relay said alarm signal overheard during the periodic listening, the alarm signal being relayed to the access point, wherein the access point is an IEEE 802.11 based hub for interfacing with an alarm network.

14. The network of claim 13 wherein the relaying station is configured to repeatedly relay the alarm signal to the access point until:

the relaying station receives an acknowledgement signal from the access point; or the relaying station has repeatedly relayed the alarm signal a maximum number of times.

15. The network of claim 13 wherein the relaying station is configured to enter a sleep mode in response to:

the relaying station receiving an acknowledgement signal from the access point; or the relaying station having repeatedly relayed the alarm signal a maximum number of times.

16. The network of claim 13 wherein the transmitting station and the relaying station are battery-powered, and the access point is powered with automating current.

17. The network of claim 16 further comprising a central unit powered with alternating current, the central unit being configured to:

receive the alarm signal from the access point; and receive commands from a user and transmit the commands to the transmitting station and the relaying station via the access point.

* * * * *